US008042701B2

(12) United States Patent
Raman et al.

(10) Patent No.: US 8,042,701 B2
(45) Date of Patent: Oct. 25, 2011

(54) INTEGRATED STRAW AND BOTTLE CLOSURE ASSEMBLY

(76) Inventors: Erez Raman, San Rafael, CA (US); Dov Schriber, San Rafael, CA (US)

( * ) Notice: Subject to any disclaimer, the term of this patent is extended or adjusted under 35 U.S.C. 154(b) by 492 days.

(21) Appl. No.: 12/324,056

(22) Filed: Nov. 26, 2008

(65) Prior Publication Data

US 2009/0139952 A1 Jun. 4, 2009

Related U.S. Application Data

(60) Provisional application No. 60/991,144, filed on Nov. 29, 2007.

(51) Int. Cl.

| | |
|---|---|
| ***B65D 41/56*** | (2006.01) |
| ***B65D 51/00*** | (2006.01) |
| ***B65D 39/00*** | (2006.01) |
| ***B65D 41/00*** | (2006.01) |
| ***B65D 43/00*** | (2006.01) |

(52) U.S. Cl. ..... 215/229; 220/212; 220/705; 220/707; 220/708; 220/709; 220/710; 215/388; 215/389

(58) Field of Classification Search ..... 220/212, 220/254.7, 705, 706, 707, 708, 709, 710; 215/229, 388, 389

See application file for complete search history.

(56) References Cited

U.S. PATENT DOCUMENTS

| | | | | |
|---|---|---|---|---|
| 4,911,315 | A | 3/1990 | Shrum | |
| 5,253,779 | A | 10/1993 | Lee | |
| 6,375,019 | B1 * | 4/2002 | Hirota et al. | 215/229 |
| 6,431,382 | B1 | 8/2002 | Li | |
| 7,210,602 | B2 * | 5/2007 | Blanchester | 222/192 |
| 2003/0102318 | A1 * | 6/2003 | Lee | 220/705 |

* cited by examiner

*Primary Examiner* — Anthony Stashick
*Assistant Examiner* — Madison L Wright
(74) *Attorney, Agent, or Firm* — Steven A. Nielsen; Allman & Nielsen, P.C.

(57) ABSTRACT

An integrated bottle enclosure includes a top cap, bottom cap, rigid straw casing and telescoping straw assembly to provide efficient means to contain a straw within a sealed bottle. Opening the top cap presents a straw ready for immediate use, or the straw may be grasped and pulled, to reveal ample straw length for keeping a consumer's mouth away from the bottle. The top cap and bottom cap connect by means to create a secure straw vault which prevents fluid from leaking out of the straw.

4 Claims, 4 Drawing Sheets

INTEGRATED STRAW AND BOTTLE CLOSURE ASSEMBLY

RELATED PATENT APPLICATION AND INCORPORATION BY REFERENCE

This is a utility application based upon U.S. patent application Ser. No. 60/991,144, entitled "Beverage Cap and Drinking Straw Assembly and Outer Straw on Container," filed on Nov. 29, 2007. This related application is incorporated herein by reference and made a part of this application. If any conflict arises between the disclosure of the invention in this utility application and that in the related provisional application, the disclosure in this utility application shall govern. Moreover, the inventors incorporate herein by reference any and all patents, patent applications, and other documents hard copy or electronic, cited or referred to in this application or IDS.

BACKGROUND OF THE INVENTION (1) Field of the Invention

The invention relates to means and methods of creating a drinking straw and integrated enclosure assembly suitable for use with a bottle. More particularly, the invention relates to a telescopic straw system integrated into a bottle closure and bottle cap system.

(2) Description of the Related Art

Several attempts to create a self contained straw and bottle cap system are known in the related art. For example, U.S. Pat. No. 4,911,315 issued to Shrum on Mar. 27, 1990 discloses a container lid and integral straw. The straw in Shrum is secured by a lid, but is relatively exposed to damage as the beverage is handled before consumption.

U.S. Pat. No. 6,431,382 issued to Li on Aug. 13, 2002 discloses a plug inserted into the top tip of a straw, with the plug being connected to a cap assembly. The plug piece may tear the upper portion of a straw during transit. The plug also adds difficulty and expense in manufacturing as gently inserting the plug into a straw is not a trivial task. Li also fails to provide easy means of resealing and covering an internal straw.

U.S. Pat. No. 5,253,779 issued to Lee on Oct. 19, 1993 discloses a self-contained pop-up straw assembly using a coil component to upwardly propel a telescoping straw member. Lee presents expense and complexity in the area of telescoping straws, as the coil component must be of sufficient rigidity to move an inward telescoping straw frictionally secured within an outside telescoping straw. Lee also presents a complex system that attempts to self center a pop-up straw that is stored in a skewed position.

There is a need in the art to overcome the shortfalls of, inter alia, Lee, Li and Shrum.

BRIEF SUMMARY OF THE INVENTION

The present invention overcomes shortfalls in the related art by presenting an unobvious and unique combination and configuration of a tapered telescoping straw assembly, a new double cap assembly with means to rigidly seal the top of a straw and protect the top of the straw from the contents of the container and provides other means to efficiently contain a straw within a container.

In one aspect of the disclosed invention, the top section of a straw is encapsulated and protected by the disclosed configuration of an upper cap assembly and a lower cap assembly. In another aspect of the invention the upper section or mouth piece section of a straw is encapsulated by three sealing systems found within the contact points between an upper cap assembly and a lower cap assembly.

The invention presents a cap, bottle enclosure and straw system where a telescoping straw is self contained within the enclosure system. The invention may be provided as a standalone product ready for use with any standard threaded bottle, or may be provided as part of a packaged drink product, wherein the contents of the product are sealed within the disclosed enclosure system and wherein the contents of the bottle are prevented from traveling out of the straw, prior to a consumer opening the top cap from the bottom cap. In either configuration, a consumer may open the top cap and find the top end of a straw ready for immediate use, or the straw may be pulled upwardly, to reveal a greater length of straw to suit needs of the end consumer.

The top cap may be secured to the bottom cap by threads operable by twisting or may be secured by a living hinge and snap system. In either configuration, the top cap may be easily replaced back upon the bottom cap. The straw will again be encapsulated by a secure enclosure sealed by securing the top cap to the bottom cap. For added security to prevent fluid from spilling out of the invention, an embodiment of the invention includes means of providing three separate sealing structures to prevent fluid from spilling out of the top of the straw and leaking out in the areas between the top cap and bottom cap.

The bottom cap or bottom cap assembly includes an internal thread structure suitable for screwing into a typical bottle, such as a plastic bottle used to contain drinking water or carbonated beverages. The bottom cap presents various surfaces suitable for interlocking into the top cap and creating a secure straw vault. The bottom cap may include a breaker seal system suitable for secure attachment to a bottle. The breaker seal system may be comprised of scored material that will break away upon rotation of the bottom cap in relation to a bottle. Thus, the bottom cap may be easily removed from a bottle, allowing the invention to be reused with other bottles.

The invention may include a rigid straw casing or straw guide that inserts into the bottom cap and secures the upper or outer portion of a telescoping straw. The bottom section of the rigid straw casing is tapered so as to prevent the downward slippage of the upper telescoping straw. In one embodiment, the bottom section of the rigid straw casing may be skewed or angled such that a lower telescoping straw will point to the bottom perimeter of a fluid container.

To facilitate proper air venting during consumption, the rigid straw casing may include an upper air void and a lower air void.

REFERENCE NUMERALS IN THE DRAWINGS

Figure 1:
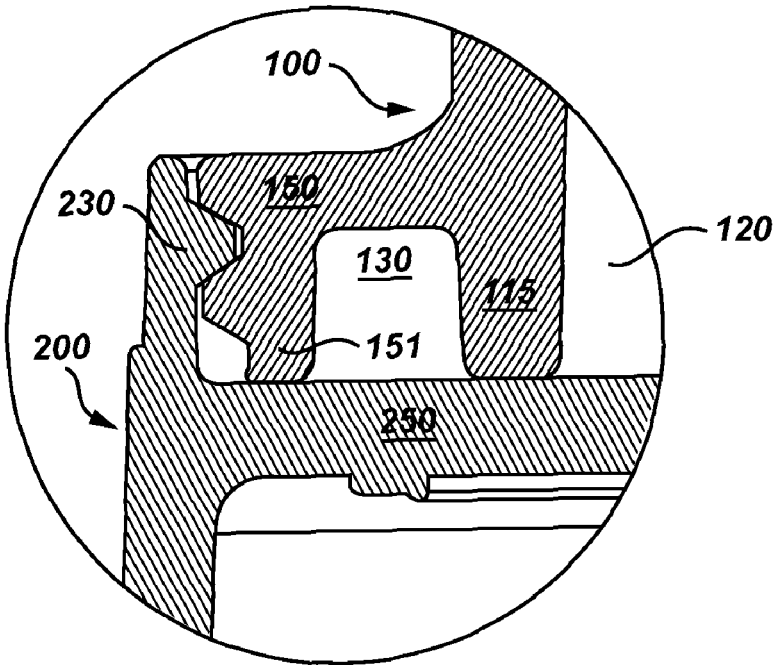
FIG. 1 is an expanded sectional view of some of the fasteners connecting the upper cap assembly to the lower cap assembly.

10 one embodiment of the invention generally
100 top cap or top cap assembly
101 upper surface of top cap assembly
102 outer vertical circular side of top cap
110 top cap straw vault for secure storage of drinking straw
115 inner vertical side or wall or sidewall of top cap used for frictional seal with inner top plate 250 of lower cap
116 sides of straw vault or circular straw vault side wall, may be used for insertion into bottom cap extrusion 220
117 outside surface of straw vault side wall 116
120 large safety chamber within top cap
130 small safety chamber within top cap
140 outer safety chamber between top cap and bottom cap
150 outer threads of top cap, used to integrate with upper threads 230 of bottom cap
151 lower contact section of outer threads, used to contact with inner top plate 250 of bottom cap
160 outer vertical sides of top cap
170 outer top shelf of top cap
200 bottom cap or lower cap assembly
201 outer vertical circular side of bottom cap
210 bottom cap shaft for insertion into insertion area 360 within rigid straw casing
220 bottom cap extrusion wall for accepting straw vault sides 116
230 upper threads of bottom cap, used to integrate with outer threads 150 of top cap
240 breaker seal
250 inner top plate of bottom cap
260 scored area of bottom cap
270 lower threads of bottom cap
300 rigid straw casing or rigid straw casing assembly
310 main body of rigid straw casing
320 inner collar area of rigid straw casing
330 lower constricted void area of rigid straw casing
331 skewed or angled lower constricted void area of rigid straw casing in an alternative embodiment
340 upper inner ridge of rigid straw casing
350 upper lip of rigid straw casing
360 insertion area within rigid straw casing for accepting bottom cap shaft 210
370 upper air void in rigid straw casing
375 lower air void in rigid straw casing
400 telescoping straw assembly
410 inner telescoping straw
420 outer telescoping straw
430 pleated surface in outer telescoping straw
440 upper section of outer telescoping straw
450 flange lip section of outer telescoping straw

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

All the above references and U.S. patents and applications are incorporated herein by reference. Aspects of the invention can be modified, if necessary, to employ the systems, functions and concepts of the various patents and applications described above to provide yet further embodiments of the invention.

Referring to FIG. 1 and FIG. 8 the integration of a top cap 100 with a bottom cap 200 may occur in one or several locations:

1. Where the sides of the straw vault 116, FIG. 7, of the top cap intersect or fit into the extrusion wall 220 of the bottom cap;
2. Where the outer vertical side 115, FIG. 7, of the top cap rests upon the inner top plate 250 of the bottom cap;
3. Where the lower contact section 151, FIG. 1, of the top cap threads 150 rest upon the inner top plate 250 of the bottom cap;
4. Where the outer threads 150, FIG. 1, of the upper cap fit into the upper threads 230 of the lower cap.

The points of contact or integration between the top cap 100 and the bottom cap 200 create one or various chambers that may be air tight and may prevent the flow of fluid from the straw vault 110 and through the voids between the top cap and bottom cap. The straw vault 110 is formed by the fitting of the sides of the straw vault 116 into the round extrusion wall 220 of the bottom cap. The sides of the straw vault may accept the extrusion wall, or the extrusion wall may accept the sides of the straw vault. The integration of the extrusion wall and sides of the straw vault may be enhanced by the use of sanitary sealant and further secured by opposing pressure created by the treads 150 of the top cap screwing into the upper threads of the bottom cap 230.

When packaged with a bottle and fluid, the straw vault 110 should be capable of preventing the contents of the bottle from breaching the straw vault. After initial consumption, any sealant between the sides 116 of the straw vault and extrusion wall 220 will be broken.

A consumer may wish to consume part of the contents of a bottle and save the remaining contents for the future. In our mobile society, there is an advantage to being able to reseal a container while keeping a drinking straw internally stored and ready for use. Unlike the known related art, the present invention presents unexpected results in fluid containment by use of the extrusion wall 220 integrated into the sides of the sides 116 of the straw vault. This interaction provides a water tight or near water tight chamber or straw vault. When the straw vault is not water tight, such as when a child or distracted automobile driver may misthread the top and bottom cap or fail to tightly twist the caps together, additional fluid chambers or safety fluid chambers may stop or greatly reduce the leakage of fluid escaping between the top and bottom caps.

In addition to the straw vault, the invention contemplates the creation of one or more safety fluid chambers:

1. A large safety chamber 120 may be formed between the outside sections of the sides 116 of the straw vault and the inside surface of outer vertical wall 115 of the top cap. Any fluid in the large safety chamber 120 will find a floor upon the inner top plate 250 of the bottom cap. It is contemplated that any fluid breaching the intersection between the extrusion wall and sides of the straw vault 116 will be confined to the large safety chamber 120.

In the unlikely event that fluid escapes between the bottom of the outer vertical side wall 115 of the top cap and the inner top plate 250 of bottom cap, such fluid would rest in the small safety chamber 130 enclosed on the bottom by the inner top plate 250 and be further confined by the vertical side wall 115 and a lower contact section 151 of the outer threads of the top cap.

In the exceptionally unlikely event that fluid escapes from the small safety chamber 130, such fluid would travel into an outer safety chamber 140 formed within the outside surface of lower contact section 151 and the intersection of the outer threads 150 of the top cap and the upper threads 230 of the bottom cap.

Figure 2:
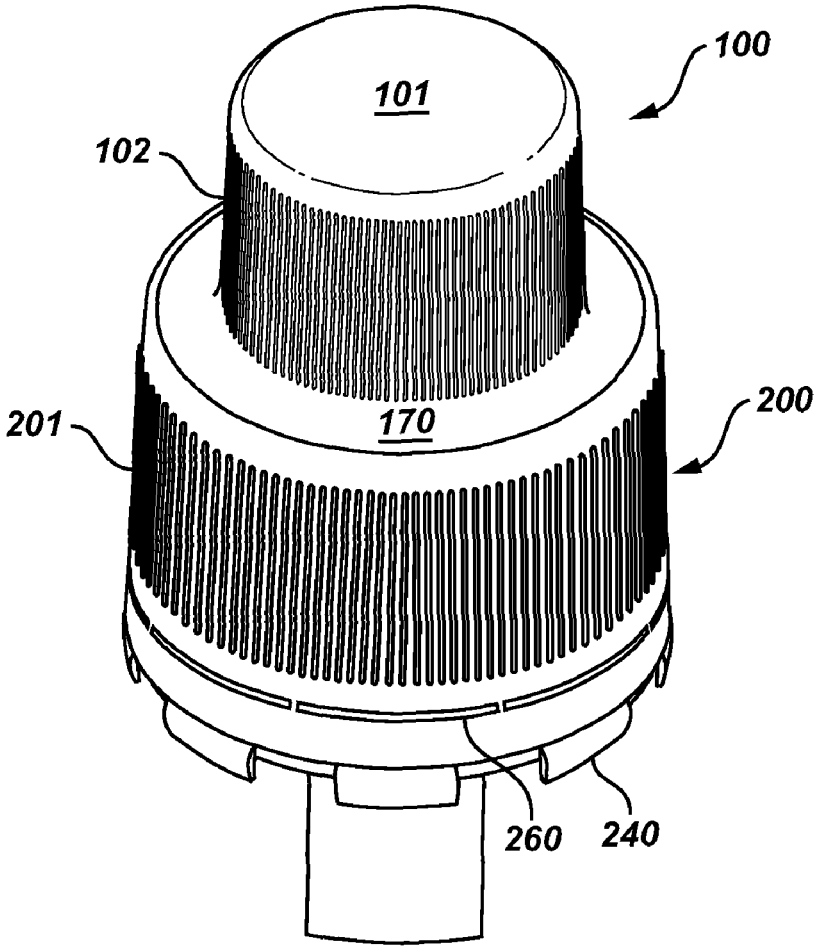
FIG. 2 is a front top perspective view of an upper cap assembly attached to a lower cap assembly.

Referring to FIG. 2 the top section 101 of the top cap is shown as a smooth surface, but, other surface treatments are contemplated. The outer vertical circular side 102 is shown with vertical ridges, but other configurations are contemplated. The outer bottom section of the top cap may be composed of an outer top self 170 that may be recessed within the bottom cap when the top cap threads 150 engage the upper threads 230 of the bottom cap. FIG. 2 also shows the bottom cap generally 200 and shows the outer vertical circular side 201 of the bottom cap. FIG. 2 also shows a scored area 260 of the bottom cap. The scored area 260 may be used as a break seal to tear the bottom cap from a bottle.

Figure 3:
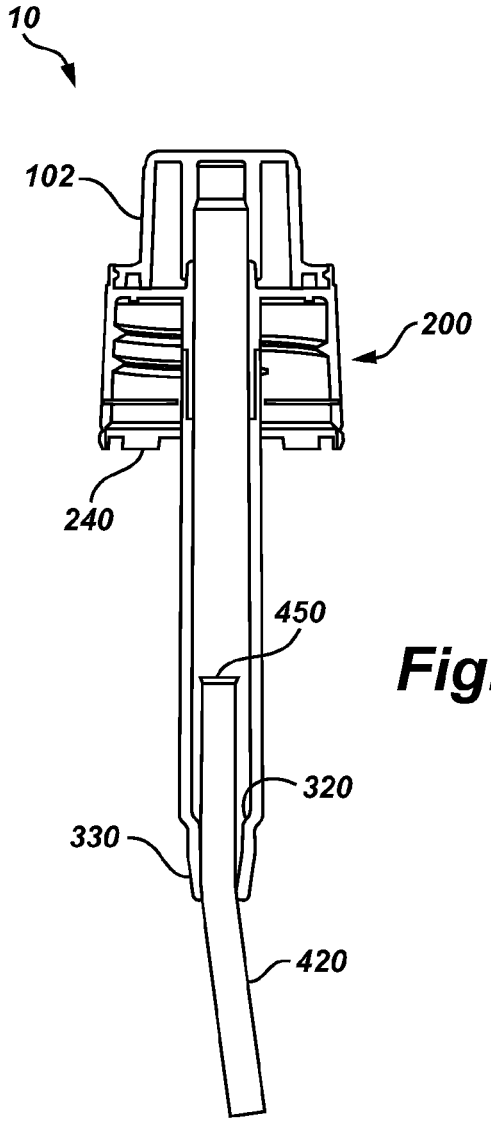
FIG. 3 is a sectional view of one embodiment of the invention.

FIG. 3 shows breaker seal 240 sections at the bottom of the lower cap 200. The main body of the rigid straw casing 310 is shown as assembled within the bottom cap 200 and with an outer telescoping straw 420. In one embodiment, the upper most part of the outer telescoping straw comprises a flange lip section 450. An inner collar area 320 of the rigid straw casing presents an area of constriction preventing the flange lip section 450 from dropping out of the rigid straw casing. The bottom section 330 of the straw casing is relatively narrow, to prevent the outer telescoping straw 420 from dropping out of the rigid straw casing.

Figure 4:
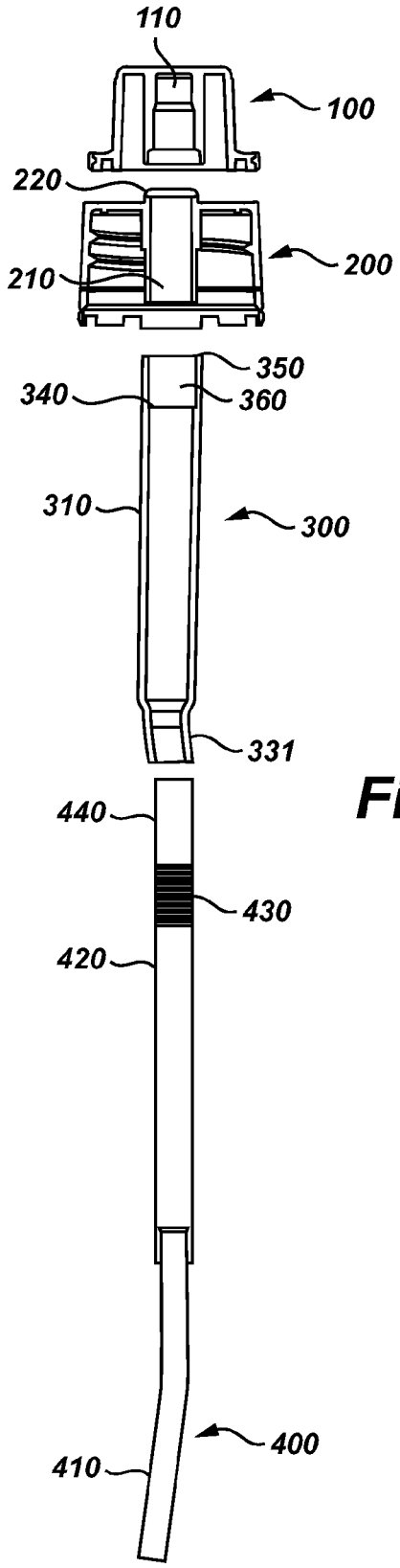
FIG. 4 is a sectional view of one embodiment of the invention in a disassembled state.

FIG. 4 presents a sectional view of the top cap 100, bottom cap 200 and rigid straw casing assembly 300 in a disassembled configuration. The lower cap extrusion wall 220 is shown at the top of the bottom cap 200. The center of the lower cap comprises a lower cap shaft 210 that may be used for insertion into the insertion area 360 of the rigid straw casing 300.

The upper lid 350 of the rigid straw casing may be inserted into the bottom cap. The insertion area 360 within the rigid straw casing may be used for accepting the bottom cap shaft 210. The upper inner ridge 340 of the rigid straw casing may act as a fitting juncture for resting next to or at the most bottom section of the shaft 210 of the bottom cap. FIG. 4 shows an alternative embodiment, wherein the lower section 331 of the rigid straw casing is skewed or angled. Such an angle may be used to direct a telescoping straw assembly 400 away from the center of a beverage container.

FIG. 4 also shows an upper section 440 of an outer telescoping straw. In an assembled position, the upper section 440 of the outer telescoping straw may rest within the straw vault 110 of the top cap 100. In order to allow the upper section of the straw to tilt, a pleated surface 430 may be used to construct a section of straw. FIG. 4 shows inner telescoping straw 410 inserted within an outer telescoping straw 420.

Figure 5:
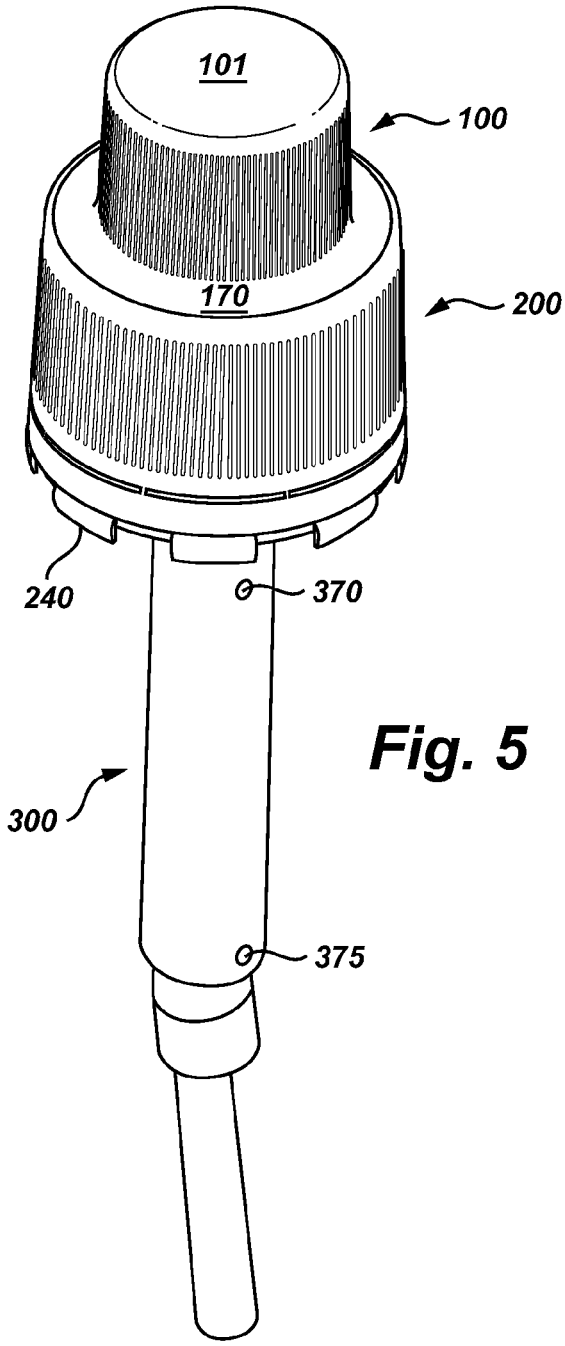
FIG. 5 is a perspective view of the invention in an assembled state.

FIG. 5 is a top perspective view of one embodiment of the invention in an assembled configuration showing the outer top shelf 170 of the top cap 100. The outer top shelf 170 of the top cap may rest within the bottom cap when the two caps are assembled. In order to facilitate venting during use of the straw assembly, a lower void area 375 and an upper void area 370 may be found within the rigid straw casing assembly 300.

Figure 6:
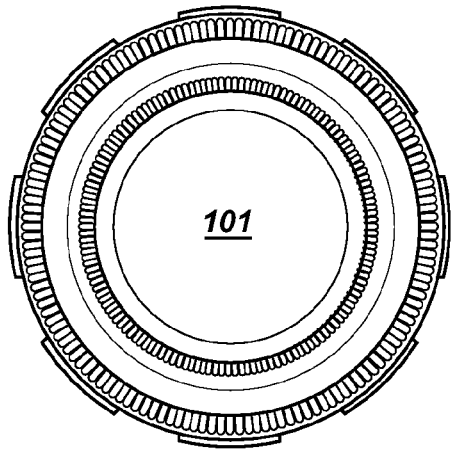
FIG. 6 is a top plan view of an upper cap assembly connected to a bottom cap assembly.

FIG. 6 shows a top plan view of a top cap 100 and bottom cap 200 in an assembled position.

Figure 7:
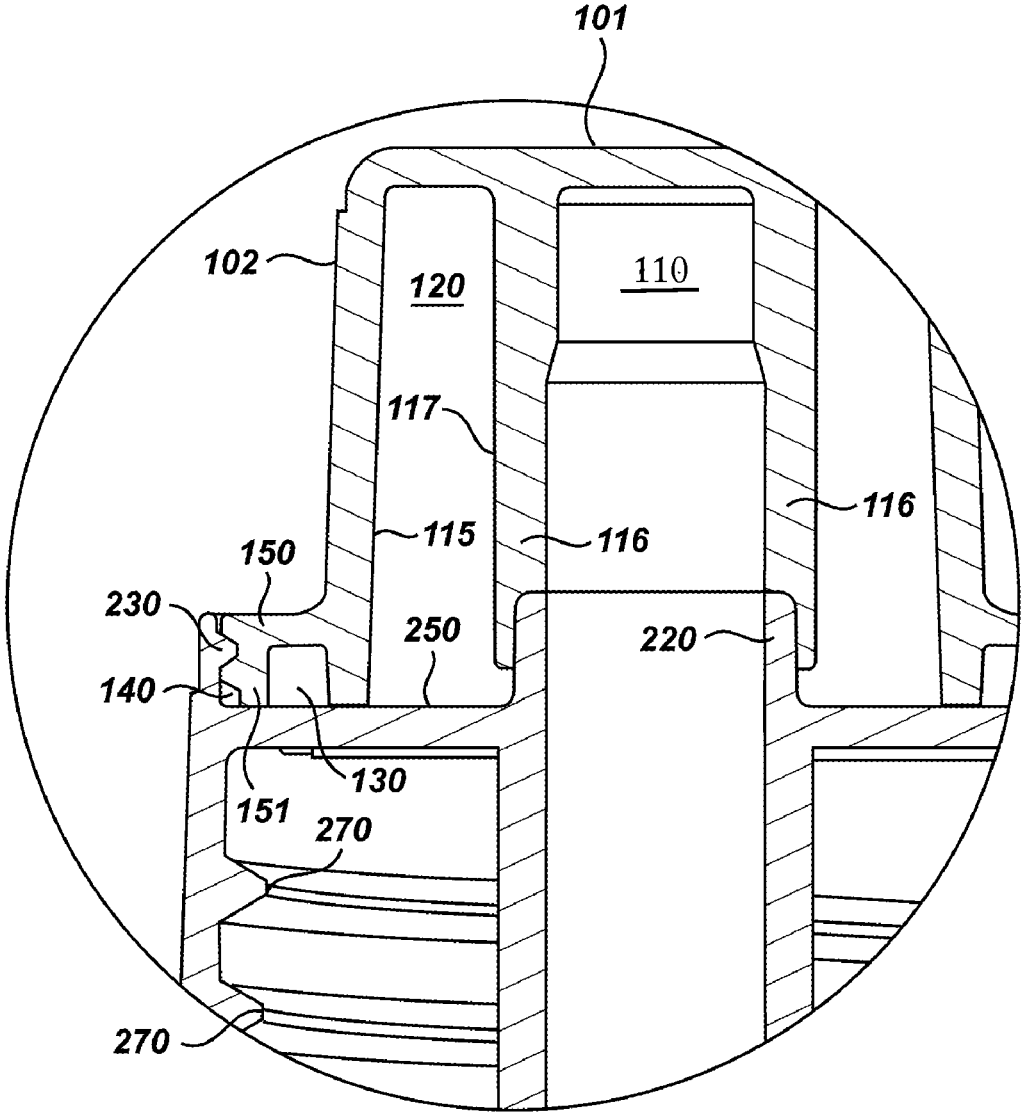
FIG. 7 is an expanded sectional view of an upper cap assembly connected to a lower cap assembly.

FIG. 7 shows a sectional view of portions of an top cap assembled to a bottom. Bottom cap threads 270 may be used to secure the bottom cap to a typical bottle.

Certain aspects of the invention may be explained in the following list of items.

1. A straw and bottle enclosure system, the system comprising:

a) a top cap assembly 100 comprising:

i. a straw vault 110 defined by a circular straw vault side wall 116 contained within a top cap;

ii. a large safety chamber 120 with sides defined by: aa) the outside surface 117 of the straw vault side wall and by bb) an inner vertical sidewall 115 contained within the top cap;

iii. a top surface 110 connecting the circular straw vault side wall 116 and inner vertical sidewall 115 and containing the straw vault 110 and large safety chamber 120;

iv. an outer top shelf 170, connected to an outer vertical circular side 102 which is in turn connected to the top exterior surface 110;

v. fastening threads 150 connected to the outer bottom portion of the outer top shelf;

b) a bottom cap assembly 200 comprising:

i. upper threads 230 used to connect the bottom cap assembly to the top cap assembly ii. an inner top plate 250 attached to the upper threads 230;

iii. an extrusion 220 wall attached to the inner top plate;

iv. a shaft 210 attached to the inner top plate 250 and extrusion wall;

vi. lower threads 270 attached to the inner top plate 250;

c) a rigid straw casing 300 comprising:

i. a main body 310 with an upper lip 350 and insertion area 360 used to connect the rigid straw casing 300 to the shaft 210 of the bottom cap 200;

ii. an upper void 370 and a lower void 375 within the main body 310 of the rigid straw casing;

iii. an inner collar area 320 within the lower section of the main body 310;

iv. a constricted void area 330 at the bottom of the main body 310;

d) a telescoping straw assembly 400 comprising:

i. an outer telescoping straw 420 retained within the main body 310 of the rigid straw casing;

ii. a flange lip 450 at the top end of the outer telescoping straw 420, the flange lip 450 having means of retention when pulled against the inner collar area 320 of the rigid straw casing; and iii. an inner telescoping straw 410, telescopically connected by insertion through the outer telescoping straw 420.

2. The system of item 1 wherein the top cap 100 includes a small safety chamber defined by the outer vertical circular side 102 of the top cap, lower contact section 151 of the outer threads of the top cap, and the inner top plate 250 of the bottom cap.

3. The system of item 2 wherein the top cap includes an outer safety chamber defined by the lower contact section 151 of the outer threads of the top cap, the upper threads 230 of the bottom cap, and the inner top plate 250 of the bottom cap.

4. The system of item 3 with sealant is applied between the inner top plate 250 of the bottom cap 200 and the inner vertical sidewall 115 of the top cap.

These and other changes can be made to the invention in light of the above detailed description. In general, the terms used in the following claims, should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

While certain aspects of the invention are presented below in certain claim forms, the inventors contemplate the various aspects of the invention in any number of claim forms.

What is claimed is:

1. A straw and bottle enclosure system, the system comprising:

a) a top cap comprising:

i. a straw vault defined by a circular straw vault side wall contained within a top cap;

ii. a large safety chamber with sides defined by:

aa) an outside surface of the circular straw vault side wall and bb) an inner vertical sidewall contained within the top cap;

iii. a top surface connecting the circular straw vault side wall and inner vertical sidewall and containing the straw vault and large safety chamber;

iv. an outer top shelf, connected to an outer vertical circular side, which is in turn connected to the top surface of the top cap;

v. fastening threads connected to an outer bottom portion of the outer top shelf;

b) a bottom cap comprising:

i. upper threads connected to a bottom cap, the upper threads used to connect the bottom cap to the top cap assembly;

ii. an inner top plate attached to the upper threads of the bottom cap;

iii. an extrusion wall attached to the inner top plate;

iv. a shaft attached to the inner top plate and extrusion wall;

vi. lower threads attached to the inner top plate;

c) a rigid straw casing comprising:

i. a rigid straw casing with a main body, the main body having an upper lip and insertion area used to connect the rigid straw casing to the shaft of the bottom cap;

ii. an upper void and a lower void within the main body of the rigid straw casing;

iii. an inner collar area adjacent to a lower constricted void area of the rigid straw casing;

iv.;

d) a telescoping straw assembly comprising:

i. an outer telescoping straw retained within the main body of the rigid straw casing;

ii. a flange lip at a top end of the outer telescoping straw, the flange lip having means of retention when pulled against the inner collar area of the rigid straw casing; and iii. an inner telescoping straw, telescopically connected by insertion through the outer telescoping straw.

2. The system of claim 1 wherein the top cap includes a small safety chamber defined by the outer vertical circular side of the top cap, lower contact section of the outer threads of the top cap, and the inner top plate of the bottom cap.

3. The system of claim 2 wherein the top cap includes an outer safety chamber defined by a lower contact section of the outer threads of the top cap, the upper threads of the bottom cap, and the inner top plate of the bottom cap.

4. The system of claim 3 with sealant is applied between the inner top plate of the bottom cap and the inner vertical sidewall of the top cap.

* * * * *